United States Patent [19]

Staats

[11] 4,122,323

[45] Oct. 24, 1978

[54] PHASE SHIFT DEVICE FOR MICROWAVE OVEN DOOR SEAL

[75] Inventor: James E. Staats, Louisville, Ky.

[73] Assignee: General Electric Company, Louisville, Ky.

[21] Appl. No.: 835,950

[22] Filed: Sep. 22, 1977

[51] Int. Cl.[2] ..... H05B 9/06

[52] U.S. Cl. ..... 219/10.55 D; 219/10.55 F

[58] Field of Search ..... 219/10.55 D, 10.55 F, 219/10.55 R; 174/35 GC, 35 MS; 126/200

[56] References Cited

U.S. PATENT DOCUMENTS

| | | | |
|---|---|---|---|
| 3,304,401 | 2/1967 | Long | 219/10.55 D |
| 3,629,537 | 12/1971 | Haagensen | 219/10.55 D |
| 3,812,316 | 5/1974 | Milburn | 219/10.55 D |
| 3,846,608 | 11/1974 | Vera Valles | 219/10.55 D |
| 4,013,861 | 3/1977 | Westfall | 219/10.55 D |
| 4,053,731 | 10/1977 | Foerstner | 219/10.55 D |
| 4,059,742 | 11/1977 | Baron | 219/10.55 D |

*Primary Examiner*—Arthur T. Grimley

[57] ABSTRACT

A pair of phase shift devices is provided for sealing a microwave oven against the leakage of microwave energy. Each phase shift device is in the form of a conductive channel member having sides of unequal width. The narrower channel side is positioned parallel to and slightly spaced from an inner surface of the door to define a capacitive gap therebetween. The wider channel side extends perpendicularly outwardly from one of the cavity walls and is effectively electrically connected thereto at the microwave frequency. The devices are particularly adapted to be used in combination with a metal mesh gasket seal and, when so used, not only serve as a backup for the metal mesh gasket but also reduce the likelihood of gasket failure. The nature of the phase shift device permits it to be easily retrofitted to a microwave oven already in service.

14 Claims, 3 Drawing Figures

86'
84'
14
82'
84'
86'
72
18
80'
75'
70
100
76'
75'
88'
12
73
86
82
84
98
102
88
84
86
34
16
80
13
76
75

PHASE SHIFT DEVICE FOR MICROWAVE OVEN DOOR SEAL

BACKGROUND OF THE INVENTION

The present invention relates generally to a microwave oven door sealing device. More particularly, the invention relates to such a sealing device which is relatively compact and which may either stand alone or be adapted to retrofit to a microwave oven already having a metal mesh gasket as a primary door sealing means. In the latter case, the present device serves both as a backup sealing means and to reduce electrical stress on the primary metal mesh gasket.

Microwave ovens for domestic use require some means for preventing leakage of the microwave energy from around the edges of the door when the door is closed. Various approaches to this energy sealing have been employed. Three in particular have been commercially employed. The first of these is direct electrical contact between the door and the oven liner. This is commonly known as a metal-to-metal seal, and may be effected for example by means of a metal mesh gasket such as is disclosed in U.S. Pat. No. 3,812,316 to Milburn. The second is a capacitive-type door seal wherein a flat surface portion around the liner and a surface portion of the door form the two plates of a capacitor. The capacitor presents nearly a short circuit to the microwave energy attempting to escape. Thirdly, various choke joint structures having cavities with an effective electrical length of either one-quarter or one-half wavelength are frequently used. Such chokes are based on a quarter wavelength transmission line impedance transformer principle, and function to present either a high impedance to block the passage of microwave energy or a low impedance to shunt the microwave energy, depending upon the particular application.

Microwave energy sealing devices such as these mentioned above have also been employed in various combination, one seal serving as a backup for the other. For example, a choke may serve as a backup for a primary metal-to-metal type seal. As another example, lossy gasketing materials such as conductive rubber or ferrite loaded rubber are commonly employed in combination with choke-type door seals. Such lossy materials absorb microwave energy, converting it to heat.

Particularly rigorous sealing requirements are found in combination ovens which are capable of both conventional and microwave cooking. Sealing problems are more difficult because the microwave sealing structure must be capable of withstanding the heat involved in the conventional cooking operation. This is particularly severe when microwave cooking is combined in a pyrolytic self-cleaning oven, because temperatures as high as 900° F. may be reached during the self-cleaning process. One prior art example of a seal adapted for this type of oven is that disclosed in the above-mentioned U.S. Pat. No. 3,812,316 to Milburn. The Milburn gasket functions both to assure electrical contact between the oven door and the oven liner lip, and to seal the oven against the escape of heat, smoke and gases.

With respect to the microwave energy sealing function effected by the electrical contact, during microwave cooking substantial currents flow in the metal cooking cavity walls. These currents are a part of electromagnetic standing waves, known as "modes," supported within the cavity. A number of different modes are possible. Each of the modes has associated with it a particular pattern of current distribution in the cavity walls. For typical TE cooking mode, current maxima occur at a number of points along the interfaces between the wall edges. This includes the interfaces between the front edges of the cooking cavity walls and the door. As a result, particular electrical stresses are placed on the metal mesh gasket where it contacts the oven liner lip.

While such a metal mesh gasket normally provides a highly effective microwave energy seal, after a period of use a very small percentage of ovens employing such a gasket may exceed the very rigid standards governing permissible levels of microwave energy leakage from ovens. Such a failure might occur for example where a food spill or the like partially covers either the oven liner lip or the gasket, thereby preventing good electrical contact. This may be aggravated due to the relatively high current flowing through the gasket as a result of its location. An increase in resistance at this relatively high current location can result in heat-producing arcing which may permanently damage the gasket.

The present invention provides a compact and effective microwave energy sealing device which may either stand alone or be used in combination with another seal such as metal mesh gasket. When used in combination with a metal mesh gasket, the present invention not only serves as a backup should the metal mesh gasket completely fail, but additionally lessens the likelihood of a gasket failure by reducing the current flow through the gasket, and resultant electrical stress. Further, the construction of the device is such that it may be retrofitted to ovens already in use with minimum inconvenience and structural change to the oven. The device may be constructed of materials which are compatible with the high temperatures associated with pyrolytic self cleaning of an oven.

SUMMARY OF THE INVENTION

It is therefore an object of the invention to provide an effective microwave oven door sealing device which is physically compact relative to a conventional quarter wavelength choke.

It is another object of the invention to provide such a sealing device which is compatible with a combustion oven including conventional cooking and pyrolytic self cleaning capability, and which may be readily installed in such an oven already in service in the field.

It is another object of the invention to provide a microwave energy sealing device which can serve as backup for a primary metal mesh sealing gasket and which also functions to shunt current away from the gasket, thereby reducing the chances of gasket failure.

It is still another object of the invention to provide such a microwave energy sealing device for retrofit to an oven which does not unduly disturb the voltage and current standing wave patterns within the oven which are essential for proper cooking operation. In connection with the foregoing object, it is an object to minimally disturb the microwave cooking performance of an oven to which the present device is retrofitted.

Briefly stated, and in accordance with one aspect of the invention, these and other objects are accomplished by a phase shift device in the form of an electrically conductive generally U-shaped channel member, the parallel sides of which are of unequal width. The channel member has a length sufficient to extend across a substantial portion of one dimension of the cavity opening. A mounting flange extends along substantially the entire length of the wider channel side, extending perpendicularly thereto in a direction away from the open side of the channel. The phase shift device is mounted to one of the cavity walls, with the mounting flange extending away from the door opening, and the channel sides perpendicular to the one cavity wall. The narrower channel side is spaced a predetermined distance from an inner surface of the door to define a first capacitive gap therebetween. Due to the one channel side being narrower, a longitudinal gap results between the edge of the narrower channel side and the one cavity wall. This longitudinal gap provides an opening between the channel interior and the outermost edge of the first capacitive gap.

One such phase shift device is associated with the top wall of the cooking cavity, and another is associated with the cooking cavity lower wall.

Effective electrical connection between the wider channel side and the one cavity wall at the frequency of the microwave energy employed in the oven is effected by means of capacitive coupling between the mounting flange and the cavity side wall. Reliance upon capacitance to provide the electrical connection permits the cooking cavity walls and the phase shift device to be and to remain coated with a suitable electrically insulating porcelain enamel, such as is commonly employed in electric ranges.

In accordance with another aspect of the invention, there is provided a door sealing arrangement for a microwave open, which arrangement includes a phase shift device substantially as described above. Additionally portions of the cavity walls and the door beyond the first capacitive gap define a second capacitive gap therebetween. A metal-to-metal contact seal, for example a metal mesh gasket, may be positioned within the second capcitive gap.

The dimensions of the channel member portion of the phase shift device of the invention are on the order of one-eighth wavelength at the microwave frequency employed in the oven. As a result, a compact device compared to a conventional quarter wave choke results.

Briefly stated, and in accordance with still another aspect of the invention, a phase shift device is provided to reduce the electrical stress on a metal-to-metal door seal, for example a metal mesh gasket, in a microwave oven. The phase shift device has a capacitive plate element with a length sufficient to extend across a substantial portion of one dimension of the door opening and is adapted to be positioned parallel to and slightly spaced from an inner surface of the door when the door is in its closed position. A capacitive gap is thereby defined therebetween to partially shunt cavity wall current away from the metal to metal seal. Additionally, a cavity wall extension means is connected to the capacitive plate element and is disposed between the capacitive plate element and the associated cavity wall to lengthen the path of cavity wall current and thereby shift the phase of the standing wave pattern such that a current maximum does not occur at the first capacitive gap. As a result of the phase shift, the effectiveness of the first capacitive gap is increased, but distortion of the standing wave pattern which would exist in the absence of the phase shift device is minimized.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENT

Figure 1:
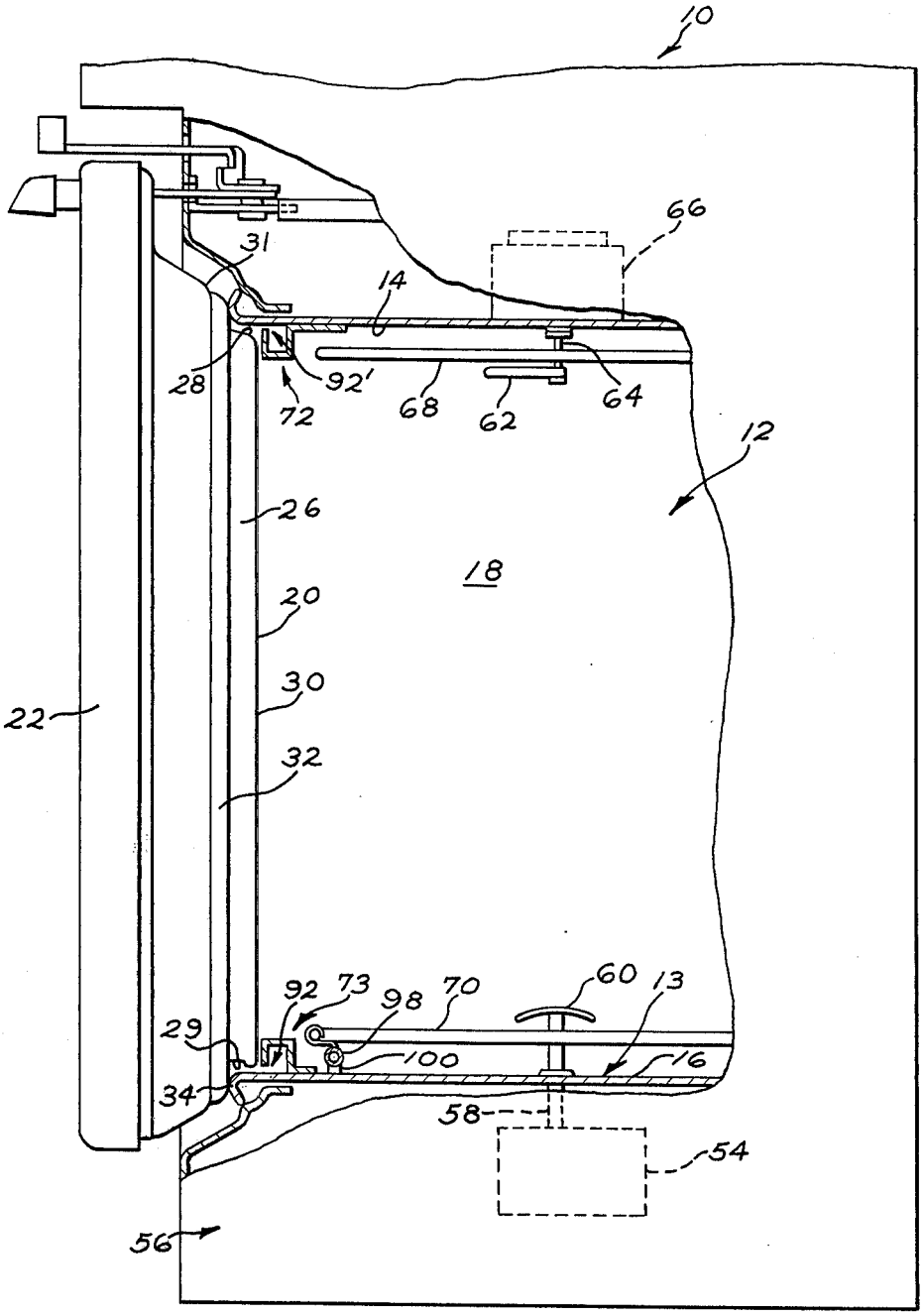
FIG. 1 is a side elevational view of a portion of an oven embodying the invention, with a portion of the right sidewall broken away.
Figure 2:
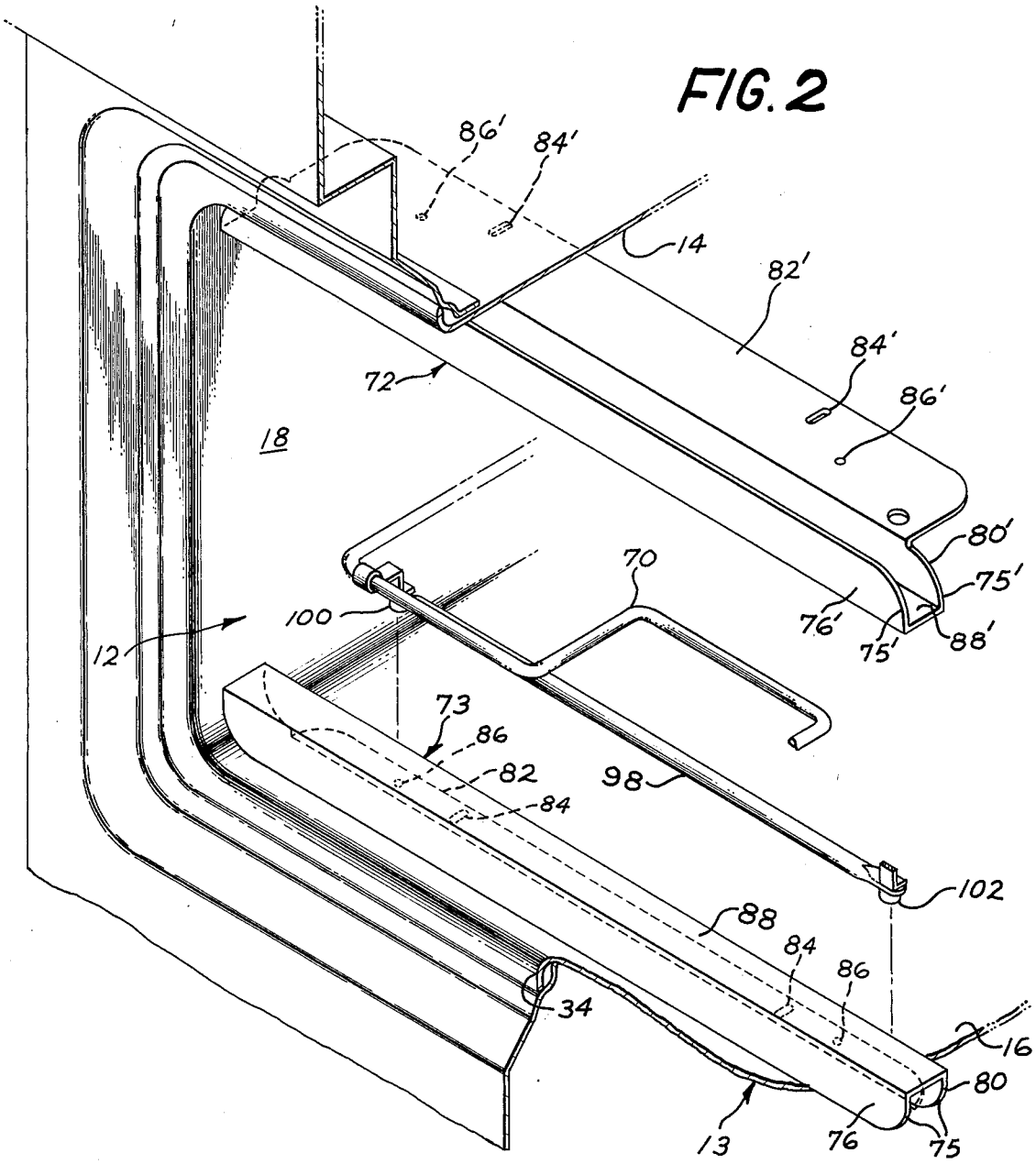
FIG. 2 is a perspective view, partially broken away and partially exploded, looking into the oven of FIG. 1 with the door removed.

Referring now to the drawings, a combination microwave and electric range 10 is of the general type shown in U.S. Pats. Nos. 3,798,404-Simon et al. and 3,812,316-Milburn, which are hereby incorporated by reference. The range 10 has a generally box-like cooking cavity 12 defined by a liner 13 having top and bottom walls 14 and 16, a left side wall 18, a right side wall (not shown), and a rear wall (not shown); and an inner surface 20 of an access door 22. The various walls defining the cooking cavity 12 are electrically conductive so that an electromagnetic standing wave pattern may be supported and confined therein. A layer of high temperature porcelain enamel 24 (FIG. 3) coats the various walls.

A plug-like inner portion 26 of the door 22 fits slightly within the cavity 12 when the door 22 is closed. The door inner surface 20 is a planar surface forming the innermost portion of the door plug 26. The door plug 26 also has a peripheral side portion extending completely around, top and bottom surfaces of which are designated 28 and 29. Preferably, the door 22 has a one-piece inner liner 30, suitably formed into the plug 26 and marginal portions 31.

A primary door sealing means is a metal-to-metal seal in the form of a dual function metal mesh gasket 32 attached to the door liner marginal portion 31 around the base of the door plug 26. One gasket function is assuring electrical contact between the door inner surface 20 and the front edges of the cooking cavity walls. Specifically, the gasekt 32 contacts a rounded lip 34 which defines the front edges of the cooking cavity liner 13. Another gasket function is sealing the oven against the escape of heat, smoke and gases. More particularly, the gasket 32 includes a glass fiber sleeve 36 having a resilient metallic mesh core 38 and a metal mesh jacket 40. Additionally, there is a reinforcing insert 42. A web portion 44 of the gasekt 32 extends through a suitable slot 46 in the door liner, to be pulled tight by a drawstring 48. Additional details of the metal mesh gasket 32 are shown and described in the aforementioned Milburn patent.

To assure good electrical contact between the metal mesh jacket 40 and the cooking cavity liner 13, the liner lip 34 has a thin conductive coating 50 of silver alloy or the like, such as is described in U.S. Pat. No. 3,459,921-Fussell et al, hereby incorporated by reference. A similar conductive silver alloy coating 52 is applied to that part of the door liner marginal portion 31 which contacts the jacket 40 of the metal mesh gasket 32.

A microwave excitation system for the cooking cavity 12 includes a magnetron 54 located in a compartment 56 below the cooking cavity 12. In the particular range 10 herein described, the magnetron 54 produces radio frequency energy of approximately 915 MHz. Energy from the magnetron 54 is carried by means of a transmission line 58 to a disc-like antenna 60 which couples the energy into the cavity 12, setting up one or more electromagnetic standing wave patterns therein. To establish a more uniform time-averaged microwave energy distribution in the cavity 12, a rotating mode exciter 62 is located near the top wall 14 of the cavity and is connected by a rotating shaft 64 to a mode exciter motor 66. Further details of the microwave excitation system may be had by reference to the aforementioned Simon et al patent.

To provide for conventional cooking within the cavity 12, broil and brake elements 68 and 70, which are sheathed electrical resistance heaters, are disposed within the cavity 12. The heating elements 68 and 70 also serve to sufficiently elevate the temperature within the cooking cavity 12 to effect pyrolytic self-cleaning of the oven 10 in accordance with the teachings of U.S. Pat. 3,121,158-Hurko. As previously mentioned in the Background of the Invention, structures associated with the cavity 12, such as the metal mesh gasket 32, must be able to withstand the high temperatures associated with conventional cooking, and the particularly high temperatures associated with self-cleaning.

In accordance with the present invention, additional sealing against the leakage of microwave energy is provided by upper and lower phase shift devices 72 and 73. The phase shift devices 72 and 73 can operate independently of the metal mesh gasket 32 to prevent the escape of microwave energy from the cooking cavity 12. Additionally, when the metal mesh gasket 32 is employed, the phase shift devices 72 and 73 serve to shunt current away from the gasket/liner lip interface, thereby reducing the electrical stress on the gasket 32 and lessening the chances of gasket failure. This is accomplished with a minimum disturbance in the electromagnetic standing wave pattern within the cooking cavity 12 compared to the standing wave pattern in the absence of a phase shift devices 72 and 73. Thus microwave cooking performance is maintained.

The particular description which follows is of the lower phase shift device 73. It will be appreciated however that the phase shift devices 72 and 73 are generally identical, and the description will apply to the upper phase shift device as well. For convenience, those elements of the upper phase shift device 72 which correspond to elements of the lower phase shift device 73 are designated by primed reference numerals.

Specifically, the lower phase shift device 73 is in the form of an electrically conductive channel member having sides of unequal width. For compatability with the rest of the oven cavity interior, the phase shift device 73 has a coating 74 of electrically insulating porcelain enamel. The device 74 has a length sufficient to extend across a substantial portion of one dimension of the cavity opening, in this case the width of the cavity opening. The ends of the device 74 terminate in curved edges 75 having curvatures corresponding to the rounded interfaces between the various walls of the liner 13.

Figure 3:
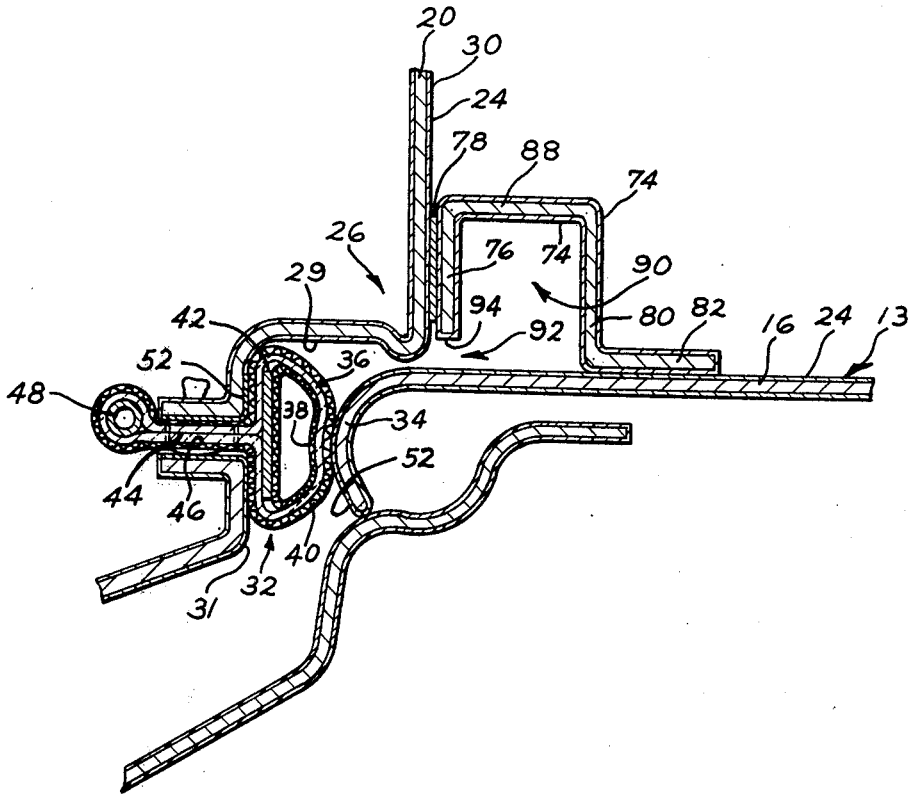
FIG. 3 is an enlarged cross-sectional view of the interface between the lower edge of the oven door and the front edge of the bottom cooking cavity wall.

The narrower channel side 76 forms a capacitive plate element and is positioned parallel to and slightly spaced from the door inner surface 20. A first capacitive gap is defined between the capacitive plate element 76 and the door inner surface 20, across which capacitive gap cavity wall current can flow as displacement current. In order to establish the correct spacing between the capacitive plate element 76 and the door inner surface 20, a temporary spacing gauge tape 78 is applied to the surface of the capacitive plate element 76 (FIG. 3). The thickness of the spacing gauge tape 78 is approximately 0.010 inch.

The wider channel side 80 extends perpendicularly outwardly from the bottom cavity wall 16 and is electrically connected thereto to form cavity wall extension means. In the illustrated embodiment, a mounting flange 82 extends perpendicularly outwardly from the taller channel side 80 and is attached to the bottom cavity wall 16. To provide for mounting of the phase shift devices 72 and 73 to the upper and lower cavity walls 14 and 16, the flanges 82' and 82 are provided with screw receiving apertures 84' and 86' (visible only on the upper phase shift device 72).

Lastly, the channel portion connecting the narrower and wider channel sides 76 and 80 and parallel to the lower wall 16, is designated 88. The channel interior 90 thereby defined formed is an inductive cavity which opens at 92 adjacent the outer edge 94 of the capacitive plate element 76.

The following table gives dimensions for a pair of phase shift devices according to the present invention which were effective in a microwave oven operating at a frequency of 915 MHz:

Table

| | |
|---|---|
| Upper phase shift device 72: | |
| Wider channel side 80' | 1 3/8 inches |
| Connecting portion 88' | 1 1/4 inches |
| Narrower channel side 76' | 1 5/16 inches |
| Gap 92' | 1/8 inch |
| Flange 82' | 2 7/8 inches |
| Overall length | 22 1/2 inches |
| Lower phase shift device 73: | |
| Wider channel side 80 | 1 3/8 inches |
| Connecting portion 88 | 1 1/4 inches |
| Narrower channel side 76 | 1 1/4 inches |
| Gap 92 | 1/8 inch |
| Flange 82 | 7/8 inch |
| Overall length | 22 1/2 inches |

The overall length of the phase shift devices 72 and 73 given in the above table is slightly less than the width of the cooking cavity 12. There is thus a gap, which is approximately ¼ inch, between either end of each phase shift device and the adjacent cooking cavity wall.

At the microwave frequency of 915 MHz employed in the oven 10, the free space wavelength, $\lambda$, is approximately 12.8 inches. One-quarter wavelength, $\lambda/4$, is in the order of 3.2 inches. From the dimensions given in the above table, it can be seen that the dimensions of the channel portion of the phase shift devices 72 and 73 are in the order of one-eighth wavelength. Thus the phase shift devices 72 and 73, in particular the inductive cavity 90, are more compact than would be a conventionally designed quarter or half-wavelength choke.

For the modes usually existing in the cavity 12 during microwave cooking, a typical guide wavelength, $\lambda g$, is 18 inches. The relative compactness of the phase shift devices 72 and 73 is thus more apparent when a comparison to guide wavelength is made. Typical phase shifter dimensions are approximately 0.15 $\lambda g$.

Proper operation of the phase shift devices 72 and 73 requires an effective electrical connection between the cooking cavity walls and each phase shift device, effective at the microwave frequency. Since both the phase shift devices 72 and 73 and the cooking cavity side walls are coated with electrically insulating porcelain enamel layers 74 and 24 respectively, direct electrical connection would be inconvenient. Nevertheless, the flange portions 82 and 82' capacitively couple to the cooking cavity walls 16 and 14 for sufficiently effective electrical connection. The capacitive connection between the upper flange 82' and the cavity top wall 14 is particularly effective because the width of the flange 82' approaches one-quarter wavelength. The lower flange 82 is smaller to avoid interference with the bake element 70, but nevertheless is sufficiently effective.

Although not a result of the addition of the phase shifters 72 and 73, it should be observed there is a second capacitive gap between the peripheral side portion of the door plug 26 (including the top and bottom surfaces 28 and 29 and the forwardmost portions of the cavity walls, just short of the liner lip 34.

In a particular oven model to which the phase shift devices 72 and 73 were fitted, a slight disturbance in the current pattern in the cavity walls resulted in the bake unit 70 "loading in" or absorbing microwave energy, leading to a decrease in microwave cooking performance. A conductive bake unit bar 98 was empirically found to be beneficial in alleviating this when mounted just below the bake element 70 between the ceramic bake unit feet 100 and 102.

To install the phase shift devices 72 and 73, the flanges 82 and 82' are first mounted in their approximate positions by means of screws (not shown), loosely driven through the slotted apertures 84'. The phase shifters 72 and 73 are manually pulled all the way forward. The door is then gently closed so that the door inner surface 20 gently pushes the phase shifters back to their proper positions, leaving a capacitive gap corresponding to the thickness of the tape 78. The phase shifters 72 and 73 are then locked in position by tightening the screws in the apertures 84 and 84' and by inserting additional screws through the round apertures 86 and 86'. Lastly the tape 78 is removed so that gaps remain between the shorter narrower sides 76 and 76' and the door inner surface 20 when the door is in the closed position.

In operation, it is believed that the first capacitive gap between the door inner surface 20 and the capacitive plate element 76 serves to carry cavity wall current across the interfaces between the front edges of the cavity walls and the door inner surface. As previously mentioned, such current flowing along the surfaces of the cooking cavity walls is essential to maintaining an electromagnetic standing wave pattern in the oven. In the particular cavity employed this current cannot be interrupted without a serious decrease in the cooking performance. Current flowing across the first capacitive gap thus also tends to shunt leakage which might otherwise escape to the exterior of the oven. Additionally, this current is effectively shunted away from the interface between the metal mesh gasket 32 and the oven liner lip 34, thereby reducing the current to the gasket and the resultant electrical stress.

Since a current maximum and a voltage minimum occur at the interface between the liner front edges and the door inner surface, capacitive coupling at this point is not particularly effective where it is desired to minimize disturbance to the current flow pattern. The additional length along the taller channel sides 80 and 80' which the cavity wall currents must travel produces a slight phase shift which has the effect of moving the capacitive coupling away from a current maximum and toward a voltage maximum. However, the phase shift introduced is not so much as to unduly disturb the current phase relationship within the cavity.

In addition, the cavity 90, having dimensions smaller than one-quarter wavelength, is an inductive cavity, presenting an inductance at the opening 92. This inductance provides a fairly high impedance at this point to block the passage of microwave energy. Additionally, series LC resonance between this inductance and the first capacitance gap is approached, tending to further produce a high impedance to block the passage of microwave energy.

An additional shunting capacitance is provided by the abovementioned second capacitive gap between the door plug peripheral side portions and the cavity walls. The first capacitive gap, the inductance at the opening 92, and the second capacitive gap together comprise a pi section low pass filter to block the escape of microwave energy from the cavity 12.

From the foregoing it will be apparent that the present invention provides a compact and effective door sealing arrangement for a microwave oven.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. In a microwave oven having a cooking cavity with a rectangular door opening, cavity walls extending to the edge of the door opening, and a door, a phase shift device serving to prevent the escape of microwave energy past the interface between the cavity walls and the door, and comprising:

an electrically conductive generally U-shaped channel member having a length sufficient to extend across a substantial portion of one dimension of the cavity opening;

the parallel sides of said channel member being of unequal width; and the wider channel side having a mounting flange along substantially the entire length thereof and extending perpendicularly thereto in a direction away from the open side of the channel;

said phase shift device mounted by means of said mounting flange to one of the cavity walls with the mounting flange extending away from the door opening, the channel sides perpendicular to the one cavity wall, and the narrower channel side spaced a predetermined distance from an inner surface of the door.

2. The phase shift device of claim 1, wherein the dimensions of said channel member are on the order of one-eighth wavelength at the microwave frequency employed in the oven, whereby a relatively compact device results.

3. The phase shift device of claim 1, wherein said mounting flange is coated with a lyer of dielectric material, and effective electrical connection between said mounting flange and the one cavity wall is accomplished capacitively.

4. A door sealing arrangement in a microwave cooking oven of the type having a cooking cavity with a rectangular door opening, electrically conductive walls extending to the edge of the door opening, and a door, which arrangement comprises:

an electrically conductive generally U-shaped channel member having a length sufficient to extend across a substantial portion of one dimension of the cavity opening, having sides of unequal width, and a mounting flange extending perpendicularly outwardly from the wider channel side in a direction away from the open side of the channel;

said channel member being generally positioned along an edge of the across opening with the narrower channel side parallel to and slightly spaced from an inner surface of the door when the door is in its closed position, defining a first capacitive gap therebetween, and with the flange extending away from the access opening and attached to one of the cavity walls;

a longitudinal gap between the edge of the narrower channel side and said one cavity wall, providing an opening between the channel interior and the outermost edge of the first capacitive gap; and there being further outward portions of the one cavity wall and the door, defining a second capacitive gap therebetween.

5. The door sealing arrangement of claim 4, wherein said one of the cavity walls to which said flange is attached is the top wall of the cavity, and which further comprises another similar channel member generally positioned along the lower edge of the access opening opposite said first-mentioned channel member, with the flange of said other channel member attached to the bottom wall of the cavity.

6. The door sealing arrangement of claim 4, wherein the cavity walls and said channel member are coated with a layer of dielectric material, and effective electrical connection between the electrically conductive portion of said one cavity wall and the electrically conductive portion of said channel member is accomplished capacitively.

7. The door sealing arrangement of claim 4, wherein the dimensions of the channel member are on the order of one-eighth wavelength at the microwave frequency employed in the oven, whereby a relatively compact sealing arrangement results.

8. The door sealing arrangement of claim 4, which further comprises a metal-to-metal contact seal positioned within the second capacitive gap.

9. The door sealing arrangement of claim 4, wherein the door inner surface which defines a capacitive gap with the narrower channel side is a portion of a plug-like structure, and wherein the second capacitive gap is defined at least partly between the side of said plug-like structure and said one cavity wall.

10. In a microwave oven having a metal-to-metal door seal providing electrical connection between a door and a cooking cavity liner generally about the periphery of the door opening, a phase shift device to reduce the electrical stress on the metal-to-metal seal, said device comprising:

a capacitive plate element having a length sufficient to extend across a substantial portion of one dimension of the door opening and adapted to be positioned parallel to and slightly spaced from an inner surface of the door when the door is in its closed position, whereby a first capacitive gap is defined therebetween to partially shunt cavity wall current away from the metal-to-metal seal;

cavity wall extension means connected to said capacitive plate element and disposed between said capacitive plate element and the associated cavity wall to lengthen the path of cavity wall current and thereby shift the phase of the standing wave pattern existing in the cooking cavity such that a current maximum does not occur at the first capacitive gap, thereby increasing the effectivensss of the first capacitive gap, the phase shift introduced being less than one-eighth wavelength thereby to minimize distortion of the standing wave pattern which would exist in the absence of said device.

11. The device of claim 10, which further comprises inductive cavity means opening near the outer edge of said capacitive plate element.

12. A device according to claim 11, which comprises an electrically conductive channel member having sides of unequal width, the narrower channel side forming said capacitive plate element, the wider channel side forming said cavity wall extension means, and the interior of the channel member forming said inductive cavity means.

13. A device according to claim 12, wherein said channel member further comprises a flange extending perpendicularly outwardly from the wider of the two channel sides in a direction away from the open side of the channel and adapted to be attached to the cavity wall.

14. A device according to claim 13, wherein said channel member is coated with a layer of dielectric material and is adapted for capacitive electrical connection between the cavity wall and the channel member.

* * * * *

UNITED STATES PATENT AND TRADEMARK OFFICE

CERTIFICATE OF CORRECTION

PATENT NO. : 4,122,323

DATED : October 24, 1978

INVENTOR(S) : James E. Staats

It is certified that error appears in the above-identified patent and that said Letters Patent are hereby corrected as shown below:

Claim 3, column 8, line 60, "lyer" should be --layer--

Claim 4, column 9, line 9, "across" should be --access--

Signed and Sealed this

*Sixth* Day of *February 1979*

[SEAL]

*Attest:*

RUTH C. MASON
*Attesting Officer*

DONALD W. BANNER
*Commissioner of Patents and Trademarks*